United States Patent [19]
Eibe
[11] 4,186,579
[45] Feb. 5, 1980

[54] ROLLING MILL GAUGE AND FLATNESS CALIBRATION SYSTEM

[75] Inventor: Werner W. Eibe, McClandless Township, Allegheny County, Pa.

[73] Assignee: Blaw-Knox Foundry & Mill Machinery, Inc., Pittsburgh, Pa.

[21] Appl. No.: 913,308

[22] Filed: Jun. 7, 1978

Related U.S. Application Data

[63] Continuation of Ser. No. 833,262, Sep. 14, 1977, Pat. No. 4,131,004.

[51] Int. Cl.[2] ..... B21B 37/08
[52] U.S. Cl. ..... 72/8; 72/21; 72/35
[58] Field of Search ..... 72/21, 8, 17, 35, 19, 72/20; 33/182

[56] References Cited

U.S. PATENT DOCUMENTS

| | | | |
|---|---|---|---|
| 2,032,584 | 3/1936 | Lengel et al. | 33/182 X |
| 3,499,306 | 3/1970 | Pearson | 72/17 |
| 3,646,686 | 3/1972 | Kreiskorte | 33/182 |
| 4,054,043 | 10/1977 | Eibe | 72/8 |

*Primary Examiner*—Milton S. Mehr
*Attorney, Agent, or Firm*—Buell, Blenko & Ziesenheim

[57] ABSTRACT

A frame carrying one or more transducers is inserted between the work rolls of a mill stand with the transducers positioned parallel to the roll axis. The outputs of the transducers are connected to a display device which when load is applied to the rolls displays the several output signals side-by-side so that variation in loading lengthwise of the rolls is made visible. The outputs of the transducers may also be interconnected with automatic gauge and crown control circuits so as to calibrate those circuits.

4 Claims, 9 Drawing Figures 27
26
25
26
27
24
30
160
158
161
129
128
110
111
108
108
130
120
109
109
133
112
159
162
136
116
140
135
114
118
160
157
137
121
125
17
16
15
16
17
145
144
143
142
127
123
124
III
119
III
126
115
147
151
150
149
148
117
153
152
113
110
111
155
154
32
31
30
29
30
31
33
132
131
138
139
107

27
26
25
26
27
24
30
160
111
110
158
129
128
108
108
109
109
130
120
133
112
176
136
135
159
140
137
121
114
125
118
160
157
143
174
175
145
142
124
144
127
17
16
15
16
17
119
149
148
126
115
147
150
151
155
154
113
177
153
152
110
31
30
29
30
31
32
33
132
131
138
139
7

ROLLING MILL GAUGE AND FLATNESS CALIBRATION SYSTEM

This is a continuation of application Ser. No. 833,262, filed Sept. 14, 1977, now U.S. Pat. No. 4,131,004.

This invention relates to mill stands. It is more particularly concerned with method and apparatus for calibrating a stand both with respect to gauge and to flatness of product.

My invention is particularly well adapted for use with mill stands provided with the closed loop integrated gauge and crown control disclosed in my application Ser. No. 746,848, filed Dec. 2, 1976, now U.S. Pat. No. 4,054,043 of Oct. 18, 1977. That application is incorporated herein by reference and made a part hereof.

In flat product mills for hot rolled plate and strip as well as for cold rolled strip, the dimensional quality of the product depends on the accuracy of the roll gap between the work rolls. Gauge is normally controlled by automatic gauge control systems and the shape by separate roll crown control systems. The most effective variable crown control system is obtained by counter bending the mill rolls opposite their deflection due to rolling forces. As far as crowning the rolls is concerned, it has always been difficult to know that the rolls are absolutely flat so that the product is also flat across its width. With thin strip the flatness is mostly controlled by the operator's observation of buckles somewhere across the width. Automatic devices have been conceived that measure the flatness behind the mill, then make corrections to the roll bending cylinders. In heavy plate rolling the shape can only be established after the finishing pass by measuring the crown. In all these cases it is an after-the-fact measurement and feedback to the control system often resulting in out-of-tolerance nonsaleable material.

With regard to automatic gauge control, load cells have been placed underneath the mill screws or the hydraulic piston in case of hydraulic roll adjustment. The zeroing and levelling of the automatic gauge control system is normally done by facing the slowly rotating work rolls under enough pressure so that all the affected mill stand components are stretched or compressed sufficiently to have a more or less linear spring characteristic from there on. During this procedure the work and back-up rolls would deflect due to roll bending, shear and flattening. In the present state of the art, these sizeable deflections had to be neglected during the calibration procedure. Only after the product was rolled the shape problems became obvious and could only then be corrected by manual or automatic control of the roll bending system.

It is an object of my invention to provide method and apparatus for calibrating the roll gap in a mill stand both for gauge and for shape flatness. It is another object to utilize for that purpose electric or hydraulic transducers to measure the pressure across the face of a roll in a mill stand and so make possible the gap calibration. It is another object to utilize the signals from those transducers for actuating a visible display. It is still another object to use those signals as additional inputs into the gauge and control system disclosed in my U.S. Pat. No. 4,054,043, above mentioned.

The apparatus of my invention comprises a frame carrying one or more transducers, the frame being dimensioned so that it can be inserted between work rolls of a mill stand with the transducers positioned parallel to the roll axis. The outputs of the transducers are connected to a display device which, when load is applied, displays the several output signals side-by-side so that variation in loading lengthwise of the rolls is made visible. Those outputs are proportional to the width of the roll gap at the positions of the respective transducers. The outputs of at least the center transducer and the two transducers adjacent the ends of a roll are also interconnected into the gauge and crown control circuits disclosed in my U.S. Pat. No. 4,054,043 so that those circuits can be calibrated against the actual dimensions of the roll gap.

Embodiments of my invention presently preferred by me are illustrated in the attached drawings, to which reference is now made.

Figure 1:
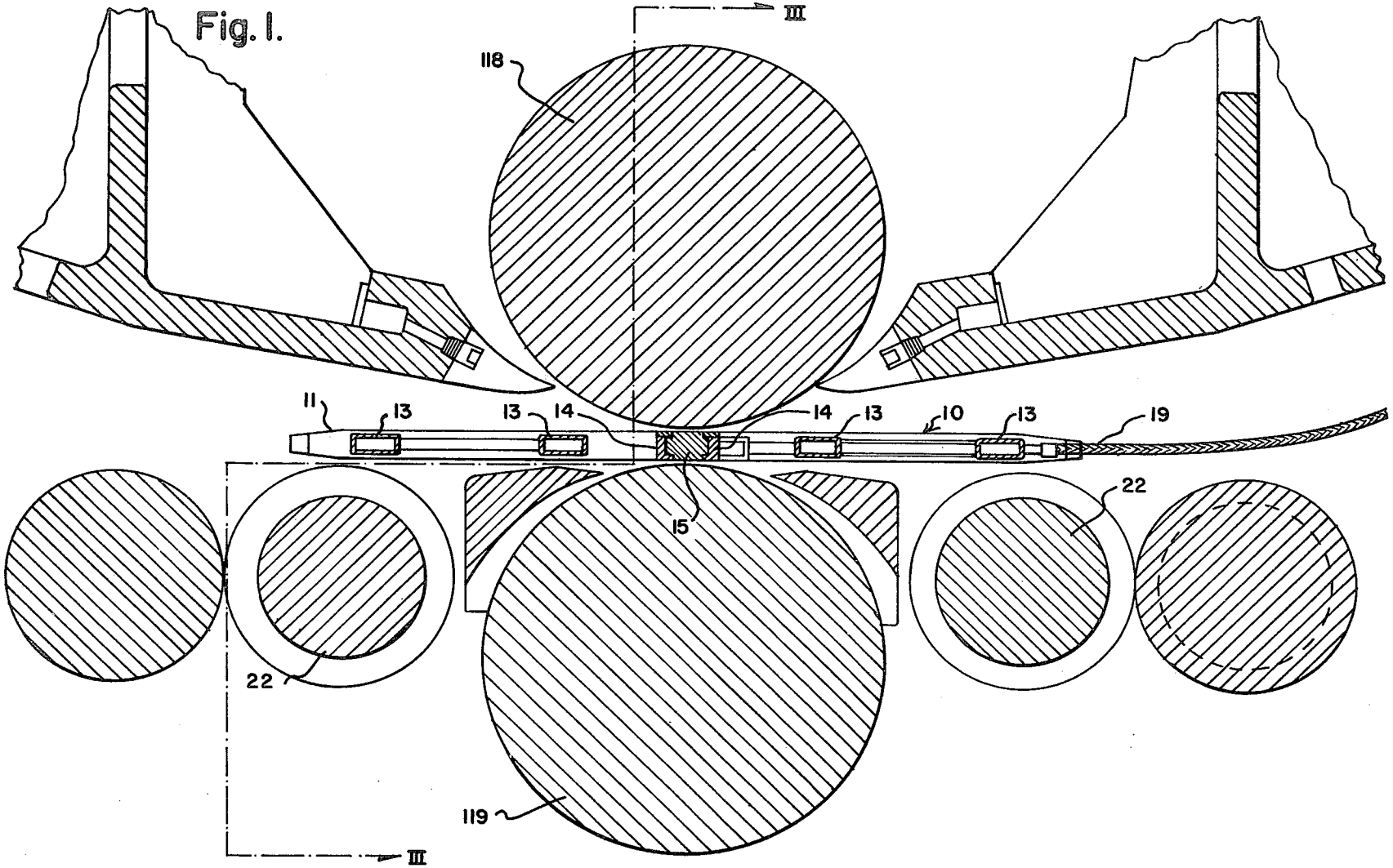
FIG. 1 is a vertical cross section of a portion of mill stand perpendicular to the roll axis showing a first embodiment of my apparatus in place between the work rolls.
Figure 8:
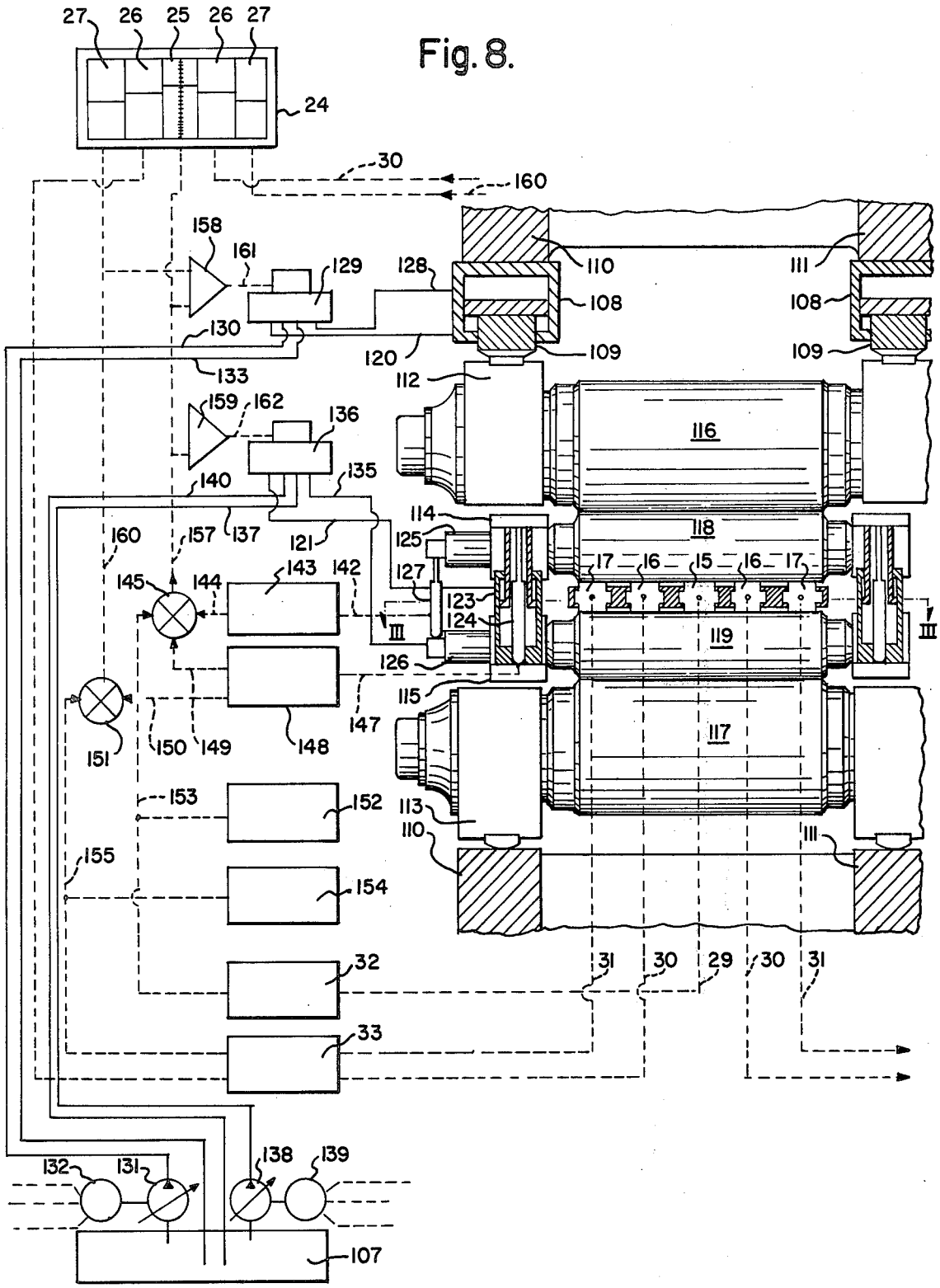
Figure 9:
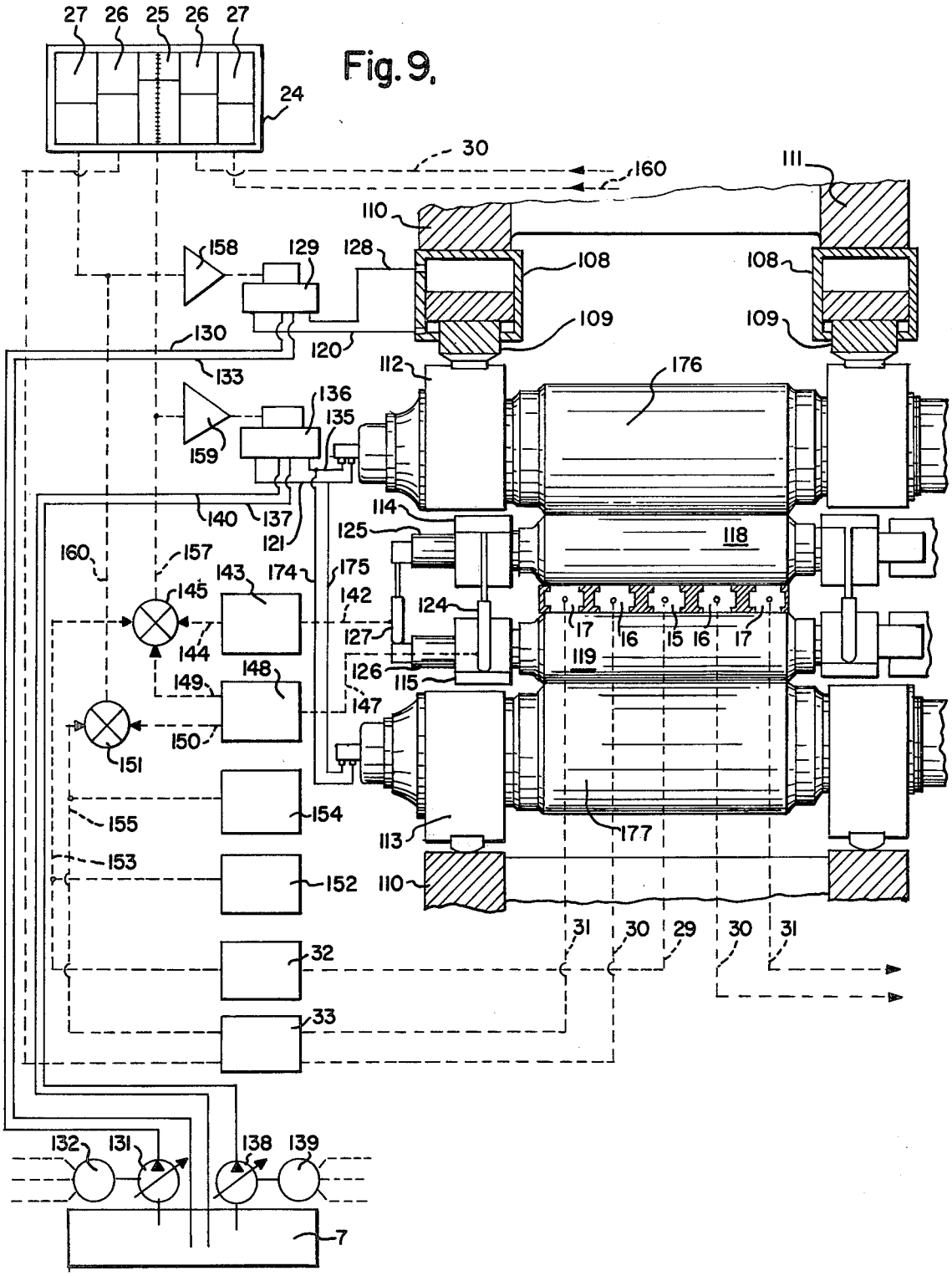

FIG. 8 is a schematic arrangement of my invention in a 4-high mill stand interconnected with the gauge and crown control apparatus shown in FIG. 1 of my U.S. Pat. No. 4,054,043; and FIG. 9 is a schematic arrangement of my invention in a 4-high mill stand interconnected with the gauge and crown control apparatus shown in FIG. 4 of my U.S. Pat. No. 4,054,043.

Figure 2:
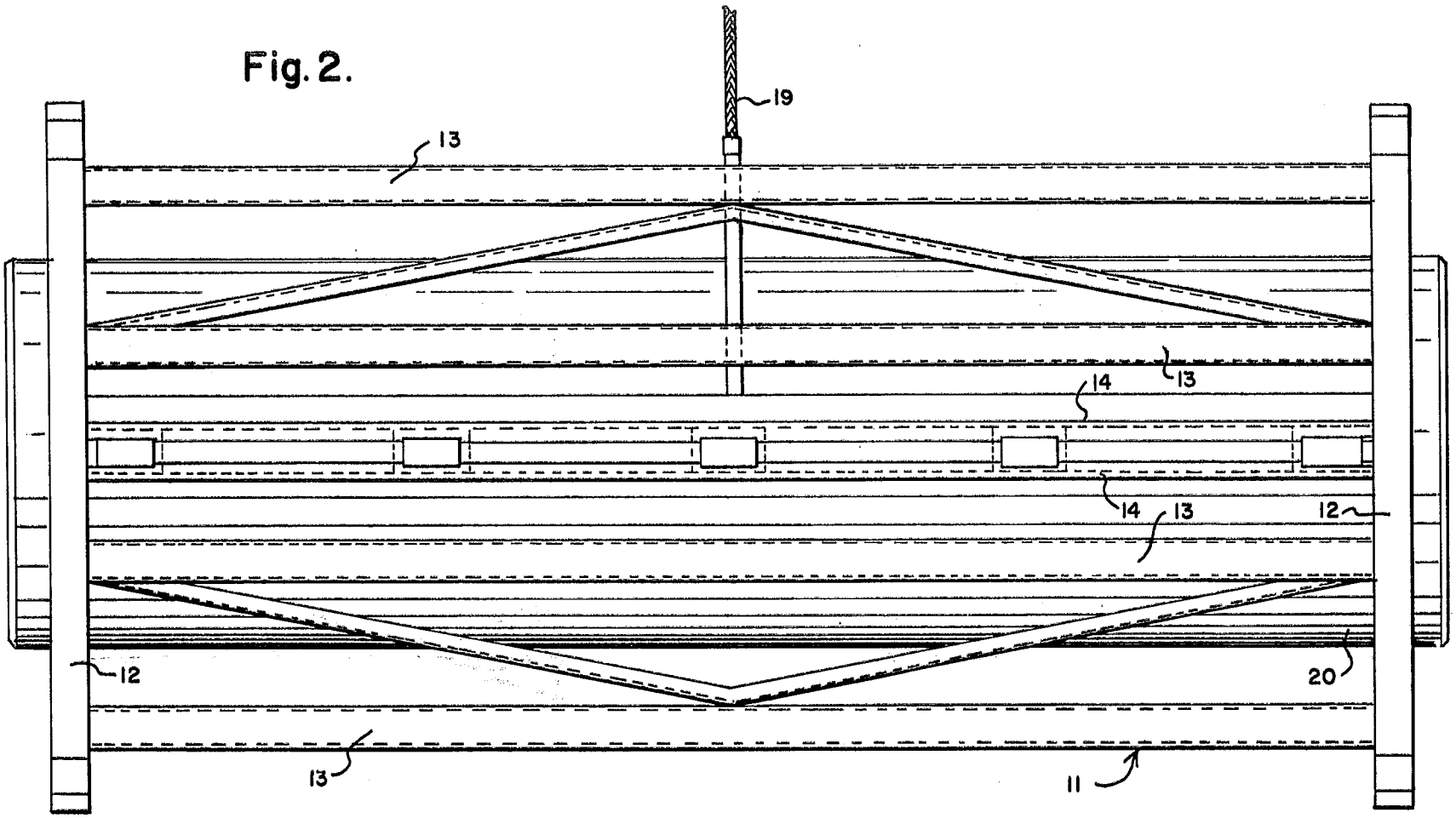
FIG. 2 is a plan of my apparatus shown in FIG. 1.
Figure 3:
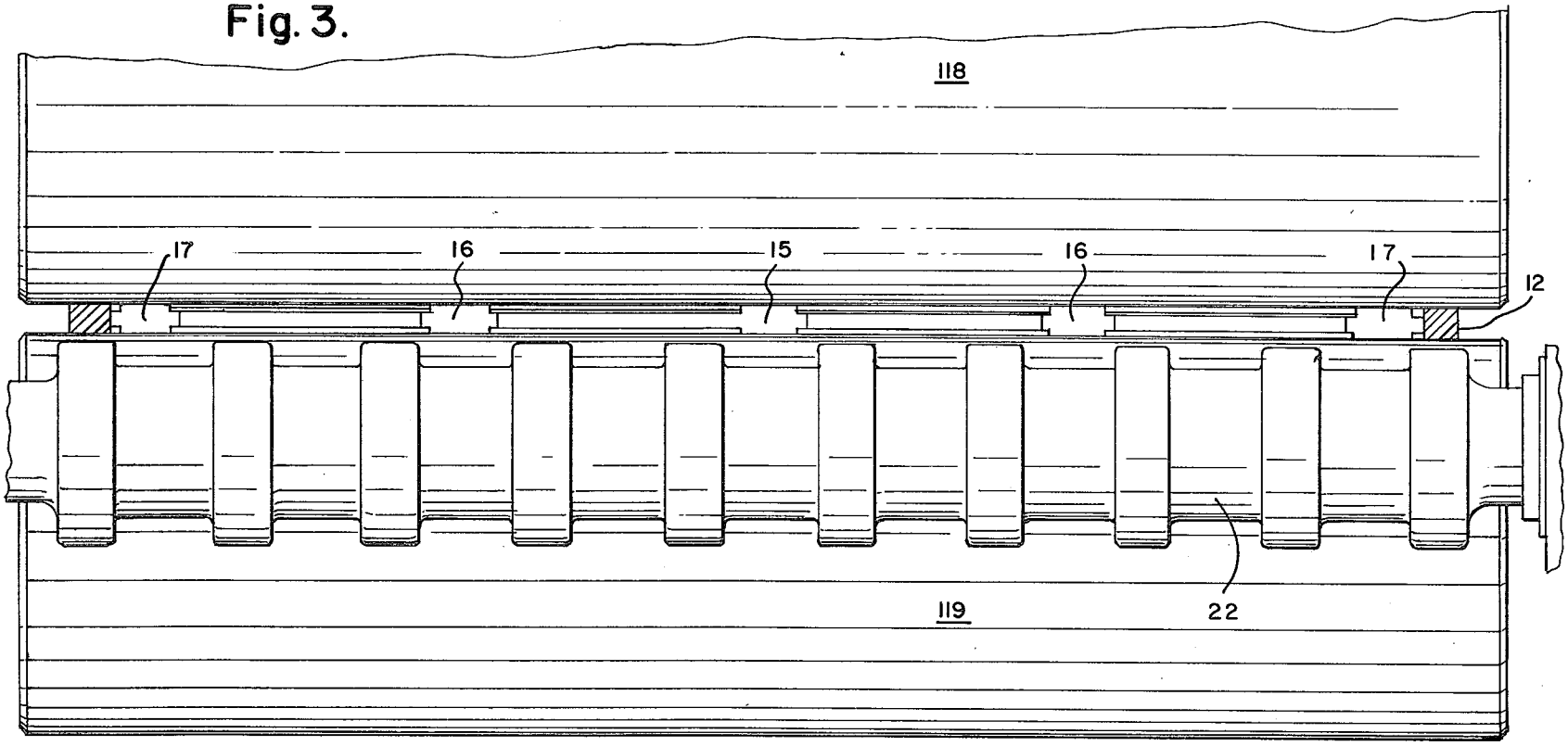
FIG. 3 is a cross-section of my apparatus taken on the plane III—III of FIG. 1.

The first embodiment of my apparatus shown in FIGS. 1, 2 and 3 comprise a rectangular frame 11 having parallel side pieces 12 and cross pieces 13 at each end of those side pieces. Intermediate cross pieces 13 is a pair of spaced-apart cross pieces 14 between which are positioned a central transducer 15, transducers 17 at each end of cross pieces 14 and transducers 16 intermediate the central transducer 15 and transducer 17 on each side. The leads from the various transducers, which conveniently take the form of load cells, are brought out in cable 19 at one end of frame 11. The height of side pieces 12 and cross pieces 13 and 14 is slightly less than the unloaded height of the load cells.

As may be seen in FIGS. 8 and 9, my apparatus also comprises display means 24 having a central scale 25, scales 27, one at each end, and scales 26 intermediate scales 25 and 27. The positions of those scales correspond respectively to the positions of load cells 15, 16 and 17 lengthwise of the rolls. Central load cell 15 is connected to means 24 so as to actuate a pointer which moves vertically on scale 25, through conductors 29, 153, 157 and crown calibrate conditioner 32. End load cells 17 are connected to scales 27 respectively through conductors 31, 155, 160 and gauge calibrate conditioners 33. Intermediate load cells 16 are connected to scales 26 through conductors 30. FIGS. 8 and 9 show the electrical connections for one side only of the mill stand and it will be understood that duplicate circuits are provided for the other side of the mill stand.

In use, frame 11 is inserted between lower work roll 119 and upper work roll 118 of a mill stand 110, those rolls, of course being separated to allow frame 11 to enter. Frame 11 is rolled in on table rolls 22 on each side of the mill stand. Frame 11 is positioned so that its load cells lie in a vertical plane through the axis of work rolls 118 and 119, and the rolls of the mill stand are then brought together against the load cells.

For any given rolling force corresponding to a given gauge of finished product, the stand can be adjusted to substantial flatness by regulating the crowning force while my apparatus 11 is in the bite of work rolls 118 and 119 until the pointers of scales 25, 26 and 27 are brought to substantially the same position. In the embodiment of my display device 24 illustrated, the scales 25, 26 and 27 are vertical and their pointers extend horizontally across them so that when the pointers are brought to the same position they form a horizontal line across the scales. The sources of rolling force are then calibrated as are the sources of crowning force, so that after my apparatus 11 has been removed from the rolls, the stand can be set up to roll flat material of the desired gauge.

In FIGS. 8 and 9 my apparatus is shown interconnected with the gauge and crown control apparatus disclosed in my U.S. Pat. No. 4,054,043, specifically that of FIGS. 1 and 4 thereof, respectively. For convenience in cross reference, the components of my above mentioned application carry in FIGS. 8 and 9 hereof reference characters which are those of the figures in my patent application, increased by 100.

The apparatus previously disclosed in my patent application in connection with FIG. 1 thereof will first here be described and illustrated in FIG. 8 hereof.

A mill stand suitable for my invention comprises an operator's side housing 110 and a drive side housing 111 tied together at top and bottom in conventional fashion. Each housing is formed with a conventional window, within which windows are positioned upper backup rolls chocks 112, lower backup roll chocks 113, and, between them, upper work roll chocks 114 and lower work roll chocks 115. Upper backup roll 116 is journalled in chocks 112, lower backup roll 117 is journalled in chocks 113, upper work roll 118 is journalled in chocks 114 and lower work roll 119 is journalled in chocks 115. A hydraulic cylinder 108 with piston 109 is positioned between the top of housing 110 and chock 112 and a like cylinder and piston is positioned in the same way in housing 111. Chocks 113 rest on the bottom of housings 110 and 111.

Between chocks 114 and 115 in housing 110 is positioned a pair of hydraulic roll-bending cylinders 123, one on each side of the roll neck. A like pair is positioned in the same location in housing 111. Centrally located within each cylinder 123, is a transducer 124. Work rolls 118 and 119 are provided with elongated necks 125 and 126 respectively which extend through the window in housing 110. Between the outer ends of necks 125 and 126 is fixed a transducer 127. Transducers 124 and 127 are preferably of the form disclosed in my U.S. Pat. No. 3,864,955.

Hydraulic fluid is supplied to pressure cylinders 108 through conduits 120 and 128 from servo valve 129. The latter is furnished hydraulic fluid through conduit 130 from pump 131 which is driven by motor 132. Pump 131 pumps hydraulic fluid from tank 107 and servo valve 129 discharges into that tank through conduit 133. In like manner, roll bending cylinders 123 are supplied with hydraulic fluid through conduits 121 and 135 from servo valve 136. That valve is furnished hydraulic fluid through conduit 137 from pump 138 which is driven by motor 139. Pump 138 pumps hydraulic fluid from tank 107 and servo valve 136 discharges into that tank through conduit 140.

The electrical output of transducer 127 is connected by conductor 142 to the input of crown signal conditioner 143. The output of conditioner 143 is connected by conductor 144 to summing junction 145. The electrical output of transducers 124 is averaged and is then connected to gauge signal conditioner 148 by conductor 147. The output of conditioner 148 is connected to summing junction 145 by conductor 149 and to summing junction 151 by conductor 150. Conditioners 143 and 148 are conventional and may include amplifiers, signal shaping elements and the like. Crown input command 152 is connected by conductor 153 to summming junction 145. Gauge input command 154 is connected by conductor 155 to summing junction 151. Those commands furnish signals which can be adjusted to correspond to the desired crown and gauge respectively and incorporate read-outs of those values. Summing junction 145 is connected by conductor 157 to the inputs of gauge servo amplifier 158 and crown servo amplifier 159. Summing junction 151 is connected by conductor 160 to the input of gauge servo amplifier 158. The output of that amplifier is connected by conductor 161 to servo valve 129 and the output of crown servo amplifier 159 is connected by conductor 162 to servo valve 136.

I have specifically described above the connections for my apparatus as applied to housing 110 on the operator's side of the mill stand. That apparatus is duplicated on the drive side of the mill stand, with the exception of trandsducer 127, and is connected to control apparatus in the same way as has been described for the operator's side of the mill stand. A transducer identical to 127 would have to be located between the drive spindles for the work rolls 118 and 119, which presents difficulties. I find that transducer 127 is adequate to furnish signals to both sides as long as the work is reasonably well centered in the rolls of the mill stand.

The operation of the apparatus of my U.S. Pat. No. 4,054,043 will here be described without reference to my calibrating apparatus here disclosed. The following description assumes that there is metal in the stand to be rolled.

Crown signal conditioner 143 and gauge signal conditioner 148 are adjusted so that their outputs are of opposite polarity. The signals generated by transducers 127 and 124 and appearing on conductors 144 and 149 respectively are brought to summing junction 145 and are there compared with the signal on conductor 153 from crown input command 152. The bending of the work roll necks 125 and 126 toward each other about the fulcrum at the roll midpoint caused by the application of rolling pressure on those roll necks is counterbalanced by bending the work rolls in the opposite direction about the same fulcrum by bending cylinders 123. The amount of this bending is initially set by adjusting the crown input command 152. Should the material entering the mill display changes in hardness, flatness or gauge, an error signal will appear on conductor 157. That error signal is applied both to crown servo amplifier 159 and gauge servo amplifier 158, so that working pressure cylinders 108 increase or decrease their force by an incremental amount and bending cylinders 123 increase or decrease their force by the same incremental amount but in the opposite direction. Thus, the sum of the vertically acting forces on housings 110 and 111 remains unchanged, and there is no change in the gauge of the work being rolled. However, the bending moment exerted on work rolls 118 and 119 is changed by the product of the change in force of bending cylinders 124 multiplied by their lever arm, the distance between the fulcrum and cylinders 123 or any distance along the face of the backup roll towards the edges. Therefore, the flatness of the work is preserved.

The gauge desired is initially set by adjustment of gauge input command 154. The signal from transducer 124 through gauge signal conditioner 148 is summed with the reference signal from gauge input command 154 in summing junction 151 and the error signal resulting is applied to gauge servo amplifier 158. In response thereto, servo valve 129 adjusts the fluid pressure in pressure cylinder 108 so as to change the roll gap and thus the signal generated by transducer 124 in the direction to bring the error signal to zero.

My apparatus, as has been mentioned, calibrates the control apparatus above described. Calibrating apparatus 11 is inserted in the bite of rolls 118 and 119. The signal from centrally located load cell 15 is passed through crown calibrator conditioner 32 to summing junction 145, the output of which on conductor 157 is displayed on scale 25 of display means 24, as well as being introduced into amplifiers 158 and 159. The signals from outer load cells 17 are passed through calibrator conditioners 33 to summing junctions 151, the outputs of which on conductors 160 are displayed on scales 27 of display means 24, as well as being introduced into amplifiers 158. If the outputs of load cells 17 are not equal, the servo amplifiers 158 on opposite side of the mill stand will adjust pressure cylinders 108 to equalize those outputs and that equalization will be made visible by display means 24. If the equalized outputs of cells 17 are different from the output of cell 15, the signal from that latter cell will actuate servo amplifiers 158 and 159 and the pressure in roll bending cylinders 123 will be adjusted to bring those outputs to the same level.

Figure 4:
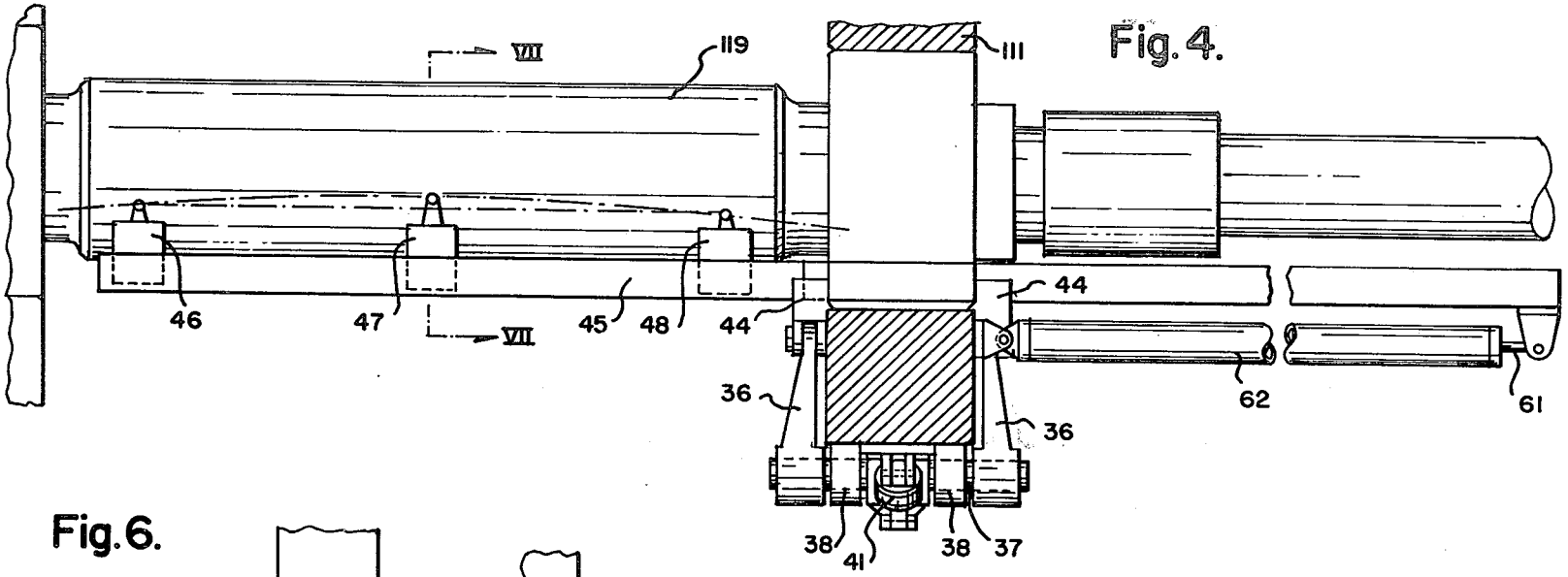
FIG. 4 is a horizontal cross-section through a mill stand between the work rolls showing in plan a second embodiment of my apparatus in place.

FIG. 9 herein illustrates my calibrating apparatus interconnected with the gauge and crown control apparatus shown in FIG. 4 of my U.S. pat. No. 4,054,043. The only differences between FIGS. 8 and 9 are those between the two embodiments of my gauge and crown control apparatus of my patent. In the first embodiment of my patent shown in FIG. 8 hereof, the work roll crowning is effected by bending the work rolls by cylinders 123. In the second embodiment of my patent shown in FIG. 9 herein, the work roll crowning is effected by adjustable crown backup rolls 176 and 177. The interconnection of my apparatus here disclosed with the control apparatus is the same for both embodiments. It is not, therefore, believed to be necessary to repeat the full description of the second embodiment of my control apparatus of my U.S. Pat. No. 4,054,043, which is contained therein nor the description of the interconnections with it of my calibrating apparatus disclosed herein which is herein before set out.

The second embodiment of my invention illustrated in FIGS. 4–7 differs from the first embodiment above described in being moved into position through window of the mill stand rather than over the mill table. Mounted on housing 111, the drive side housing, is a pair of arms 36, one on each side of the housing. Those arms are affixed at opposite ends of a shaft 37 which is journalled in brackets 38 affixed to housing 111, so that arms 36 pivot in brackets 38. Also affixed to shaft 37 between brackets 38 is a pair of crank arms 39, the outer ends of which are pivotally connected to the outer end of a piston rod 40 of a hydraulic cylinder 41, the other end of which is affixed to mill housing 111 so that cylinder 41 swings arms 36 toward and away from work rolls 118 and 119. The free ends of arms 36 are pivotally connected to channel members 44 which face the work rolls. In those channel members 44 is fitted an elongated member 45 so as to slide therein parallel to the work rolls and inside the mill stand window. Member 45 extends outside housing 111 on the drive side, and is pivotally connected at its outer end to the piston rod 61 of a hydraulic cylinder 62, the other end of which is pivotally connected to arm 36 on the outside of housing 111, so that cylinder 62 slides member 45 from a position in which its inner end abuts the inside face of housing 111 to a position in which its inner end approaches the inside face of housing 110.

Figure 5:
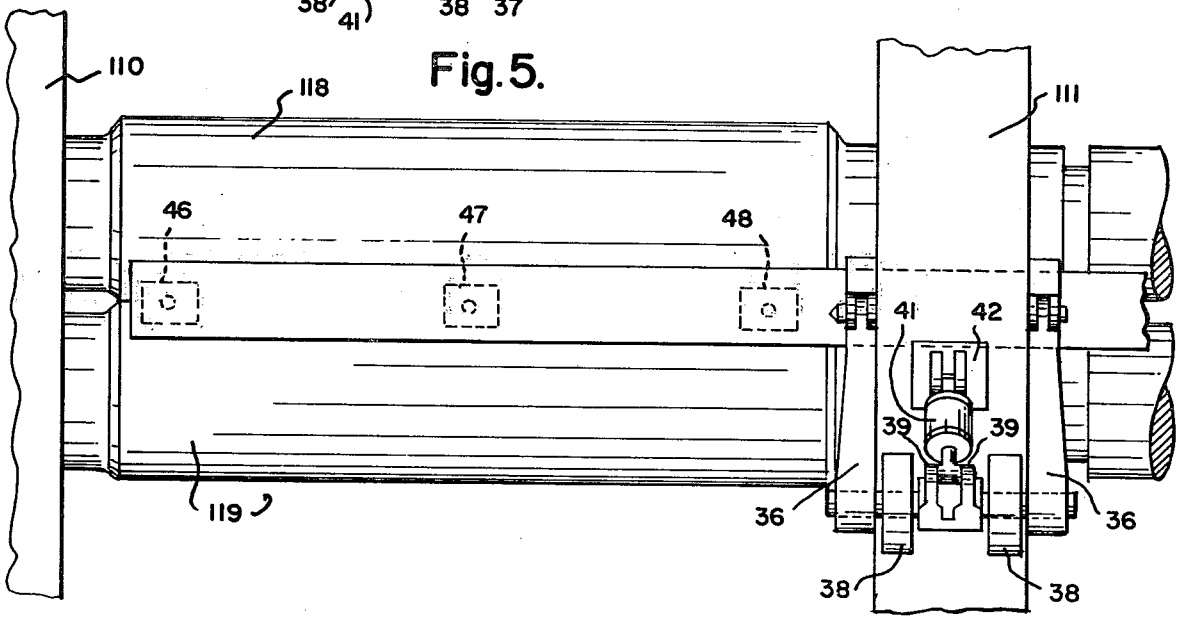
FIG. 5 is an elevation of the apparatus of FIG. 4.
Figure 6:
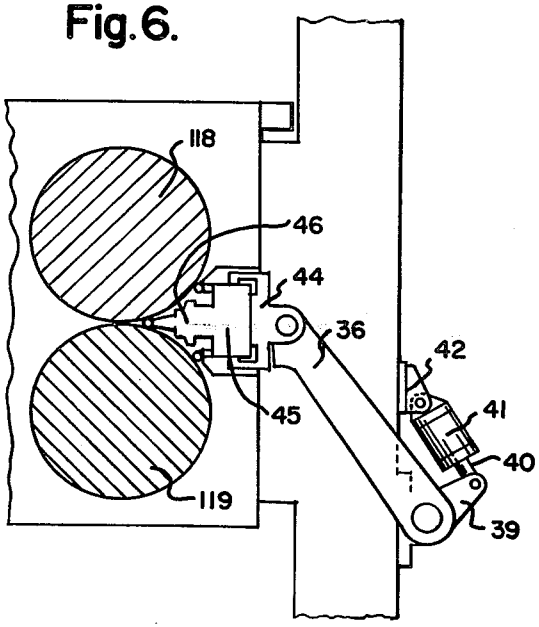
FIG. 6 is an end elevation of the apparatus of FIGS. 4 and 5.

Member 45 carries one or more transducers. In FIGS. 4 and 5 it is shown carrying three such transducers 46, 47 and 48. Transducer 47 is positioned so as to be located at the longitudinal center of the work rolls when member 45 is fully extended between housings 110 and 111. Transducer 46 is positioned to be located at the ends of the work rolls adjacent housing 110 and transducer 48 is positioned to be located at the ends of the work rolls adjacent housing 111. However, as will appear, I may also use one roll gap transducer only, and position it at succesive locations lengthwise of the work rolls by cylinder 62.

Figure 7:
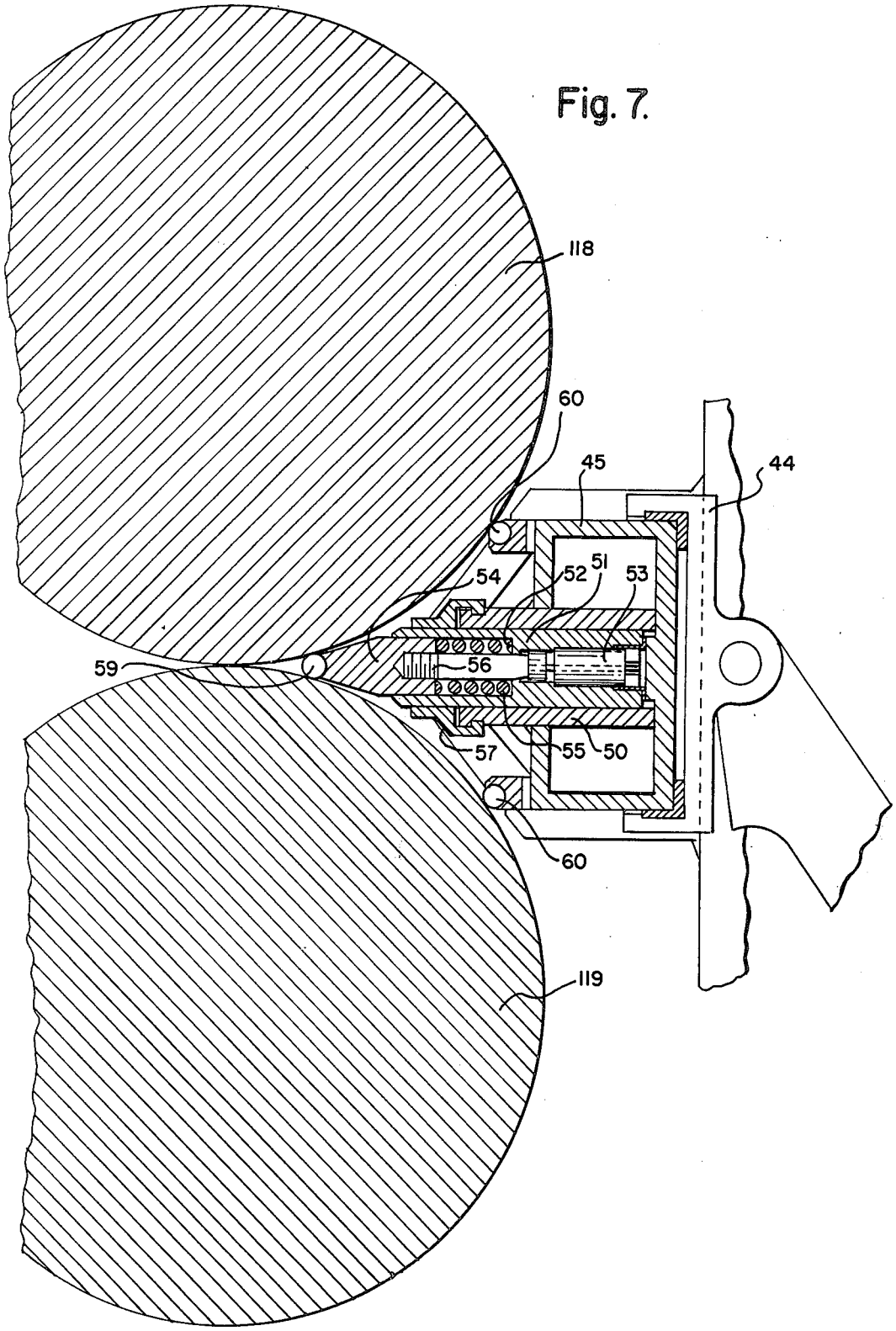
FIG. 7 is an enlarged cross-section through the apparatus of FIG. 4 taken on the plane VII—VII thereof.

The structure of my roll gap transducer is shown in FIG. 7. A cylindrical housing 50 is fixed to member 45 extending toward the work rolls therefrom. In housing 50 and extending therefrom toward the work rolls is a hollow cylinder 51 having an internal shoulder 52 intermediate its ends. A linear transducer element 53 is fixed within cylinder 51 adjacent its base. The electric leads from transducer element 53 are brought out through a cable 19 described in connection with the first embodiment of my invention. A plunger 54 fits slideably within cylinder 51 extending beyond the open end thereof and is urged outwardly by coil spring 55 which bears against the inside of plunger 54 and shoulder 52. A rod 56 threaded into the inside end of plunger 54 passes through coil spring 55 and abuts the movable element of transducer element 53. Plunger 54 is held in alignment with housing 50 by a cap 57 which fits over the upper end of housing 50 but through which plunger 54 passes. The outer end of plunger 54 which is tapered to a smaller diameter holds a spherical feeler tip 59. Spherical support tips 60 are affixed to member 45 above and below feeler tip 59, so as to make steadying contact with upper and lower work rolls 118 and 119.

The embodiment of my calibrating apparatus above described is normally withdrawn from the space between mill housings 110 and 111 through the window in housing 111 by hydraulic cylinder 62. Arms 36 are raised so as to withdraw member 45 and its associated transducers from the gap of the work rolls by cylinder 41. When the apparatus is to be used, cylinder 62 is operated to move member 45 through the window in mill housing 111 into the space between that housing and mill housing 110. If member 45 carries these roll gap transducers 46, 47 and 48 as shown in FIGS. 4 and 5, member 45 is moved to its extreme position in which transducer 47 is located at the longitudinal center of the work rolls. Then cylinder 41 is operated to move those transducers into the roll gap. Spring 55 holds plunger 54 in its outermost position and feeler tip 59 carried by it makes contact with the roll gap before support tips 60 make contact with work rolls 118 and 119. Plunger 54 is thus forced back against spring 55 until support tips 60 do make contact. Movement of plunger 54 actuates transducer element 53 and produces a signal therefrom.

It is possible by the use of the second embodiment of my invention above described to employ one transducer only and move it lengthwise of the work rolls by sliding member 45 stepwise, so as to sample the roll gap at any number of desired locations. In such a case, a display device more sophisticated than that described herein is desirably employed.

The apparatus of the second embodiment of my invention above described may be interconnected with the gauge and crown control apparatus of my U.S. Pat. No. 4,054,043 in the same way as has been described herein with respect to the first embodiment of my invention.

The apparatus of the first embodiment of my invention is especially useful for calibrating reversing rolling mill stands. In such mills the necessary clearances between chocks and housing and elsewhere in the stand, which cannot be perfectly symmetrical, result in optimum flatness crowning and rolling pressures in one direction of rolling which differ slightly from those for the other direction of rolling. In such reversing stands, my apparatus is rolled in over a mill table in one direction of rolling so as to position its transducers in the bite of the work rolls and the rolling and crowning pressures are adjusted for optimum flatness and gauge in the way hereinbefore described. The zero settings for the respective pressure applying means are noted or recorded. My apparatus is then rolled through the gap, and brought back in the reverse direction of rolling so as to position its transducers in the bite of the work rolls, and the adjusting procedure is repeated. The zero settings of the respective pressure applying means in the reverse direction of rolling are also noted. Thus a reversing mill stand can be rapidly set up for rolling a product of optimum flatness and gauge in either direction.

In the foregoing specification I have described presently preferred embodiments of my invention; however, it will be understood that my invention can be otherwise embodied within the scope of the following claims.

I claim:

1. Apparatus for calibrating the gap between working rolls of a rolling mill stand comprising transducer menas to convert the width of gap into a signal, frame means for mounting said transducer means, said frame means being dimensioned for insertion into the gap between working rolls so as to bring said transducer means against the working rolls and for removal therefrom, said transducer means including a spring-urged feeler tip projecting beyond the frame and transducer means positioned to contact the working rolls near their line of contact but short thereof and movable against said spring away from said line of contact only, and a pair of support tips, one above and one below the feeler tip positioned to contact the working rolls at a greater distance from their line of contact than the feeler tip.

2. Apparatus for calibrating the gap between work rolls of a rolling mill stand in combination with a rolling mill stand, the apparatus for calibrating the gap between work rolls comprising transducer means to convert the width of gap into a signal, frame means for mounting said transducer means, said frame means being dimensioned for insertion into the gap between the work rolls so as to bring said transducer means against the work rolls and for removal therefrom, and means for conducting signals from said transducer means out of the gap, and the rolling mill stand comprising pressure means to vary the gauge of the metal in the mill stand, means for varying the crown of the work rolls, means to measure the separation between work rolls at the chocks thereof and provide a gauge signal therefrom, means to determine the inclination of a work roll axis to the horizontal and produce a crown control signal therefrom, means to control the pressure means in accordance with the gauge signal and means to control the crown varying means in accordance with the crown control signal, and including means for combining the signal from transducer means adjacent the chocks algebraically with the gauge signal and means for combining the signal from centrally located transducer means algebraically with the crown control signal.

3. Apparatus of claim 1 in which the frame means are dimensioned to be inserted into the gap between the rolls through the window of a roll stand housing, said frame means comprising an elongated member and including a horizontally disposed hollow member in which said elongated member slides, means for effecting sliding motion between said hollow member and said elongated member, and means for mounting the hollow member on a roll stand housing for moving said hollow member toward and away from the roll gap inside the window of the housing.

4. Apparatus of claim 3 in which the transducer means comprise a single transducer.

* * * * *